United States Patent [19]

Yang

[11] Patent Number: 4,858,633

[45] Date of Patent: Aug. 22, 1989

[54] STABLE TELESCOPIC CENTERPOST OF MULTIPLE-FOLD UMBRELLA

[76] Inventor: Chi-Kuo Yang, P.O. Box 10160, Taipei, Taiwan

[21] Appl. No.: 338,041

[22] Filed: Apr. 14, 1989

[51] Int. Cl.[4] ..... A45B 19/00

[52] U.S. Cl. ..... 135/25 R; 135/75

[58] Field of Search ..... 135/23, 25 R, 37, 40

[56] References Cited

U.S. PATENT DOCUMENTS

| | | | |
|---|---|---|---|
| 1,108,217 | 8/1914 | Ostman | 135/25 R |
| 1,250,292 | 12/1917 | Erickson | 135/25 R |
| 2,068,067 | 1/1937 | Okun | 135/25 R |
| 3,705,593 | 12/1972 | Weber | 136/25 R |

FOREIGN PATENT DOCUMENTS 2179855 3/1987 United Kingdom .

*Primary Examiner*—David A. Scherbel
*Assistant Examiner*—Lan Mai

[57] ABSTRACT

A telescopic centerpost of a multiple-fold umbrella includes an upper retainer having an upper catch protruding leftwardly for supporting a left portion of a slider of umbrella canopy and spokes and a slider straightener having a protrusion protruding rightwardly for retaining a right portion of the slider for keeping the slider stably vertically, and at least a reinforced catch having two balls respectively engageable with two sets of double holes respectively formed in an inner tube and an outer tube for firmly coupling the inner and outer tubes.

6 Claims, 3 Drawing Sheets

STABLE TELESCOPIC CENTERPOST OF MULTIPLE-FOLD UMBRELLA

BACKGROUND OF THE INVENTION

A conventional telescopic centerpost of a multiple-fold umbrella as shown in FIG. 1 comprises an arcuate spring plate A having its upper catch C1 supporting a slider or runner S of umbrella spokes and having its lower catch C2 operatively coupling an upper tube T1 and a lower tube T2 telescopically connected together. In order to retract so many telescopic tubes within the slider S, the aperture S1 should be large enough for retracting the tubes of the centerpost. However, a width of the upper catch C1 can not be made too large since the catch C1 must be limitedly retracted into the tube T1 during a retraction of the centerpost, thereby causing an unstable supporting of the slider on the upper catch C1 of the spring plate A. Meanwhile, the catch C1 only protrudes leftwardly to support a left portion of the slider so that a right portion of the slider will be collapsed inclinedly, causing a local stress or deformation of the spokes and canopy of the umbrella.

Tilmann Schultes et al. disclosed a shortenable umbrella frame having a telescopic stick in their U.K. patent application GB No. 2179855 A, in which a plug 6 having annular shoulder 6A is formed in the stick for firmly coupling an upper tube 2*c* and a lower tube 2*b* as retained by a catch 5 as shown in their FIG. 1. When extending the telescopic tubes 2*b*, 2*c*, the tubes are frictionally engaged at plug 6 and shoulder 6*a* for a stable extension of the stick 2, which however requires a bigger force to separate the two tubes 2*c*, 2*b* when retracting the stick 2. The catch 3 with a single ball 3*a* may only exert a very limited spring force for fastening the telescopic tubes, which may then be easily loosened during a vibrational movement of the umbrella.

The present inventor has found the drawbacks of the telescopic stick or centerpost of a conventional umbrella, and therefore invented the present centerpost with stable structure and convenient operation.

SUMMARY OF THE INVENTION

The object of the present invention is to provide a telescopic centerpost having an upper retainer supporting a left portion of a slider of umbrella spokes and canopy, a slider straightener formed inside an upper tube having an extension protruding rightwardly for retaining a right portion of the slider for stabilizing the slider vertically, and at least a reinforced catch each catch having two balls for firmly coupling an upper tube with a lower tube of the telescopic centerpost.

DETAILED DESCRIPTION

Figure 1:
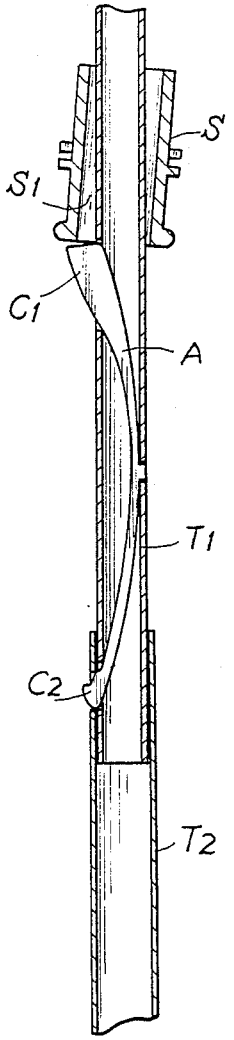
FIG. 1 PRIOR ART
FIG. 1 shows a prior art of a centerpost of a conventional umbrella.
Figure 2:
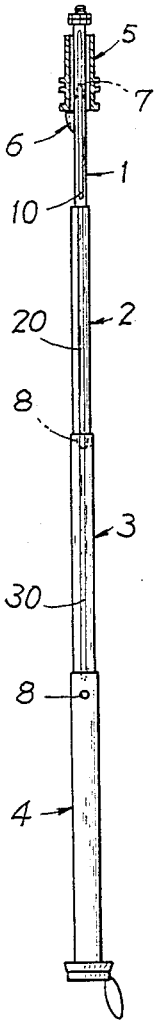
FIG. 2 is an illustration of the present invention when extending the telescopic centerpost.

As shown is FIGS. 2–5, the present invention comprises: a first tube 1 formed on an upper portion of a centerpost of the present invention, a second tube 2 extendibly formed under the first tube 1 and retractably receiving the first tube 1, a third tube 3 extendibly formed under the second tube 2 and retractably receiving the second tube 2, a handle tube 4 formed on a lower portion of the centerpost retractably receiving the third tube 3, a slider 5 for securing spokes (not shown) of an umbrella canopy movably jacketed on the first tube 1, an upper retainer 6 formed in the first tube 1 extendibly supporting the slider 5, a slider straightener 7 held in the first tube 1 for retaining the slider 5 vertically, and at least a reinforced catch 8 coupling the second tube 2 and the third tube 3.

The upper retainer 6 also couples the first tube 1 and the second tube 2. The third tube 3 and the handle tube 4 may also be coupled by the reinforced catch 8 or other kinds of conventional catches. Each tube is formed with a longitudinal groove 10 or 20 or 30 therein so that the tubes 1, 2, 3 can be telescopically retracted or extended without twisting or rotation.

The upper retainer 6 includes: a slightly arcuate spring plate 61 generally embedded in a cylindrical bore portion 11 of the first tube 1 having a central lug 62 engaged with a central notch 15 of the tube 1, an upper catch portion 63 protruding outwardly from an upper portion of the spring plate 61 through an upper left slot 13 formed in the tube 1, a rear extension 64 formed on a rear (right) end of the upper catch 63 engageable with a right notch 14 formed in tube 1, and a lower catch 65 protruding outwardly from a lower portion of the spring plate 61 through a lower left slot 16 formed in the tube 1 and through an upper slot 22 of the second tube 2 having central hole 21 for telescopically receiving the first tube 1. The lower catch 65 will couple the first tube 1 with the second tube 2. The upper catch 63 will support a lower perimeter 53 of the slider 5 at its left portion.

Figure 3:
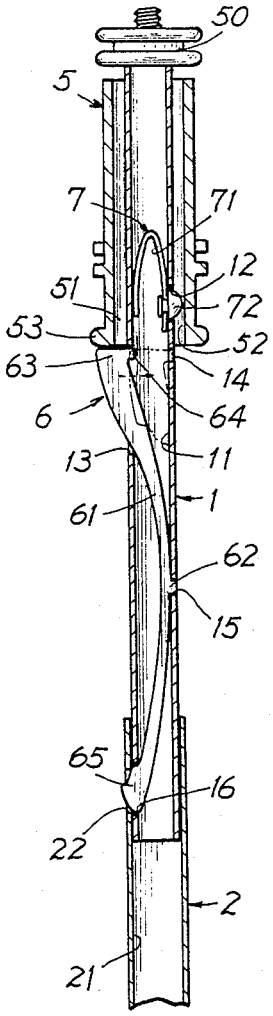
FIG. 3 is a partial sectional drawing of the present invention showing an upper retainer and a slider straightener.
Figure 3A:
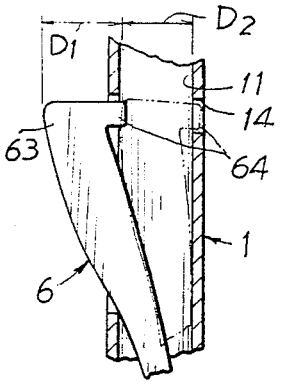
FIG. 3*a* is an illustration showing an upper catch portion of the upper retainer of the present invention.

The length D1′ of the upper catch 63 and the rear extension 64 is larger than a diameter D2 of the bore portion 11 of first tube 1 as shown in FIG. 3A. When retracting the catch 63 inside the bore 11 of tube 1, the catch 63 is received within a circumferential outer surface of the first tube 1 and the rear extension 64 is engaged with the notch 14 for a smooth retraction of tubes of the present invention.

The slider straightener 7 includes: an U-shaped spring plate 71 secured in an upper portion of the first tube 1, and a protrusion 72 protruding outwardly through a notch 12 formed in an upper right portion of the first tube 1 to resiliently retain a cylindrical bore portion 52 of the slider 5 in order to stabilize the slider 5 vertically. The protrusion 72 protrudes rightwardly in a direction opposite to an extending direction of the upper catch 63 of the upper retainer 6 protruding leftwardly as shown in FIG. 3. The protrusion 72 forces the slider 5 rightwardly in order to balance a gravitational force of a right portion of the slider 5. The slider 5 has its left portion supported on the catch 63 of the upper retainer 6, whereas the right portion of the slider 5, even not supported by the retainer 6 is resiliently retained by the protrusion 72 of the slider straightener 7, thereby being kept vertical for preventing its collapse or inclination as shown in FIG. 1.

Figure 4:
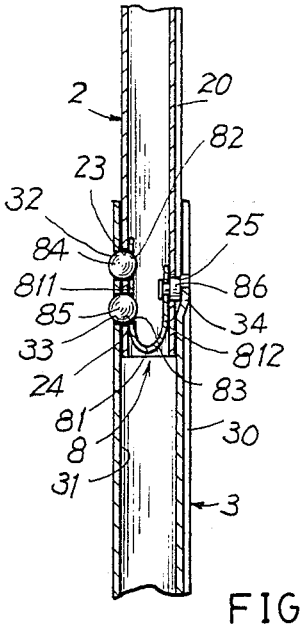
FIG. 4 is a partial sectional drawing of the present invention showing a reinforced catch.
Figure 5:
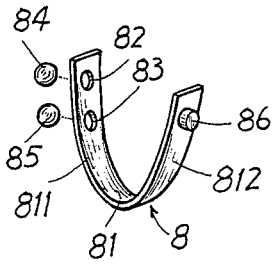
FIG. 5 is a perspective view of the reinforced catch of the present invention.
Figure 7:
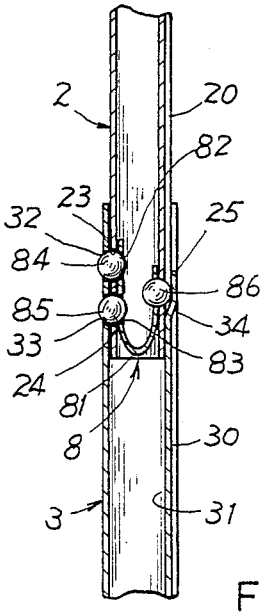
FIG. 7 shown an application of the reinforced catch of the present invention as shown in FIG. 6.

The reinforced catch 8 as shown in FIG. 5 includes: an U-shaped spring plate 81 retained in an inner tube such as a second tube 2 which is telescopically connected with an outer tube such as the third tube 3 as shown in FIG. 4, two balls 84, 85 preferably made of steel inserted in two holes 82, 83 formed in a left arm 811 of the plate 81, and a protrusion means 86 formed on a right arm 812 of the plate 81. The left-side balls 84, 85 protrude leftwardly through holes 23, 24 formed in a lower portion of the tube 2 to be snugly received by two holes 32, 33 formed in an upper portion of the third tube 3 having a central hole 31 for receiving the second tube 2 so that the two balls 84, 85 may resiliently couple the tube 2 with tube 3 firmly. The protrusion means 86 may be a cylindrical head 86 as shown in FIGS. 4, 5 or other shaped protrusions secured on the right arm of the plate 81 protruding rightwardly through a hole 25 formed in a lower portion of the second tube 2 opposite to the holes 23, 24 to be limited by a hood portion 34 formed on an upper portion of the third tube 3 and tapered downwardly to connect a tube wall of the third tube 3. When retracting the tubes 2, 3, a compression force between the handle tube 4 and the first tube 1 may force the hood portion 34 of the third tube 3 to depress the right-side protrusion means 86 inwardly and also force the two balls to slidingly disengage from the holes 32, 33 to allow a sliding retraction of the tubes. When extending the tubes 2, 3, the two balls 84, 85 may couple the two tubes 2, 3, firmly which tubes are uneasy to be disengaged by an accidental external force.

Figure 6:
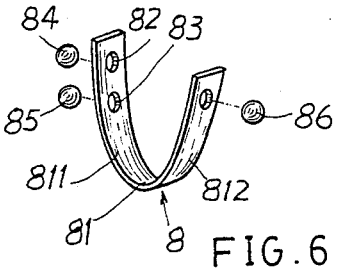
FIG. 6 shows another preferred embodiment of the reinforced catch of the present invention.
Figure 8:
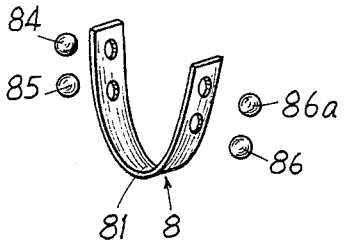
FIG. 8 shows still another preferred embodiment of the reinforced catch of the present invention.
Figure 9:
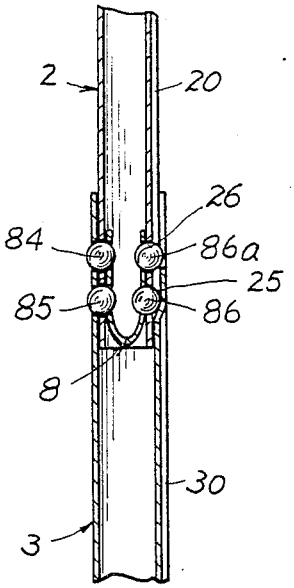
FIG. 9 shows an application of the reinforced catch as shown in FIG. 8.

The protrusion means 86 may be a single ball 86 as shown in FIG. 6, 7; or modified to be double balls **86, 86*a* as shown in FIGS. 8, 9. In FIG. 9, two holes 25, 26 should be provided in a lower right portion of the second tube 2 for respectively protruding the two balls 86, 86*a*. The ball 85 or 86 may be slightly smaller than the ball 84 or 86*a*** for smoother disengaging of two tubes as coupled by the balls.

The present invention has the following advantages superior to a conventional telescopic centerpost:

1. The slider 5 may be stably retained on an upper end of the stick or centerpost by the aid of the retainer 6 and the straightener 7 to be vertically erected for homogeneously distributing a stress tensioned on an umbrella canopy and spokes. The rear extension 64 with the upper catch 63 may have larger space for holding the slider 5, even having a larger aperture 51 in the slider 5.

2. The reinforced catch 8 may couple an inner tube with an outer tube by its two balls 84, 85 for "reinforcing" the fastening force of the two tubes coupled together for preventing any unexpected collapse of an extending umbrella.

3. Even the retainer, the catch and the straightener are all served for firmly stabilizing an extending umbrella, their structure and mechanism can be manipulated easily and conveniently.

I claim:

1. A Telescopic centerpost of a multiple-fold umbrella comprising:

a plurality of hollow tubes telescopically retracted or extended with one another having a slider of spokes and canopy extendibly retained on an upper portion of the centerpost and a handle tube formed on a lower portion of the centerpost;

an upper retainer generally formed as an arcuate spring plate held in a first hollow tube of the hollow tubes having an upper catch protruding leftwardly from an upper slot of the first tube for supporting a left portion of the slider and having a lower catch protruding leftwardly through a lower slot formed on a lower portion of said first tube and through an upper slot formed on an upper portion of a seconed tube extendibly connected under said first tube thereby coupling said first tube and said second tube;

the improvement which comprises: said upper retainer having a rear extension formed on a rear portion of said upper catch retractably engageable with a right notch formed in an upper portion of said first tube, said upper catch with said rear extension operatively protruding leftwardly for supporting a left portion of said slider; and a slider straightener formed as an U-shaped spring plate having a protrusion secured on one end of said spring plate protruding rightwardly through a protrusion notch formed in an upper portion of said first tube to resiliently retain a cylindrical bore portion inside said slider to stabilize said slider vertically by the aid of said upper catch of said upper retainer.

2. A telescopic centerpost according to claim 1, wherein an inner tube of the hollow tubes is coupled with an outer tube by a reinforced catch generally formed as U-shape;

the improvement which comprises: said reinforced catch having two balls inserted in two ball holes formed in a left arm member of an U-shaped spring plate protruding outwardly through another set of two ball holes formed in said inner tube to be snugly received by further set of two ball holes formed in said outer tube for firmly coupling said inner tube with said outer tube.

3. A telescopic centerpost according to claim 2, wherein said reinforced catch includes a protrusion means formed on a right arm member of the U-shaped spring plate of the reinforced catch, said protrusion means protruding rightwardly through a protrusion hole formed in a lower portion of said inner tube to be limited by a hood portion formed on an upper portion of said outer tube, said hood portion tapered downwardly towards a tube wall of said outer tube, whereby upon a retraction of said tubes of said centerpost, the hood portion may depress said protrusion means inwardly to disengage and retract two said tubes.

4. A telescopic centerpost according to claim 3, wherein said protrusion means is selected from: a cylindrical head and at least a ball formed on a right arm member of the U-shaped spring plate of said reinforced catch opposite to the other two said balls formed on the left arm member.

5. A telescopic centerpost according to claim 1, wherein a length of said upper catch and said rear extension is larger than an inside diameter of said first tube for protruding a larger area for supporting said slider; said length of said upper catch and said rear extension being generally equal to an outside diameter of said first tube for a smooth retraction of said hollow tubes.

6. A telescopic centerpost according to claim 2, wherein the two balls may have equal or different diameters.

* * * * *